US005844246A

United States Patent [19]

Marchione

[11] Patent Number: 5,844,246

[45] Date of Patent: Dec. 1, 1998

[54] RADIATION PROTECTIVE GARMENT AND SHOULDER SUPPORT

[76] Inventor: Robert L. Marchione, R.R. 1, Box 60, Brookfield, Vt. 05036

[21] Appl. No.: 927,473

[22] Filed: Sep. 11, 1997

Related U.S. Application Data

[63] Continuation-in-part of Ser. No. 879,434, Jun. 20, 1997.

[51] Int. Cl.[6] ..... G21F 3/02

[52] U.S. Cl. ..... 250/516.1

[58] Field of Search ..... 250/516.1, 519.1; 2/455, 48

[56] References Cited

U.S. PATENT DOCUMENTS 4,417,146 11/1983 Herbert ..... 250/516.1

5,028,796 7/1991 Swartz ..... 250/516.1

*Primary Examiner*—Kiet T. Nguyen

*Attorney, Agent, or Firm*—William Nitkin

[57] ABSTRACT

A radiation protective garment and radiation protective garment shoulder supports for use with a radiation protective garment are disclosed having at least one stay member which transfers all the weight of the garment off the wearer's shoulders to the waist/pelvic area of the wearer by means of a support belt securely positioned around the lower portions of the stay member(s) located at the waist area of the wearer. Such stay member(s) can be disposed internally within the radiation protective garment or worn under such garment.

17 Claims, 6 Drawing Sheets

RADIATION PROTECTIVE GARMENT AND SHOULDER SUPPORT

This application is a continuation-in-part of my previous application entitled Radiation Protective Garment, Ser. No. 08/879,434 filed Jun. 20, 1997, now pending.

BACKGROUND OF THE INVENTION

1. Field of the Invention

This invention resides in the area of radiation protective garments and more particularly relates to the use of stay members and a support belt to raise the radiation protective garment off the wearer's shoulders so that the weight of the radiation protective garment is supported by the support belt at the wearer's waist rather than on the wearer's shoulders.

2. Description of the Prior Art

During the past thirty years, while many new medical imaging technologies have been introduced and accepted, the usage of an older modality, x-ray fluoroscopy, has quietly proliferated. X-ray fluoroscopy has become an imaging tool not only of choice, but also of necessity. X-ray fluoroscopy provides the ability to see within the body in real time and has moved from usage for simple x-ray diagnosis to usage in a vast array of medical treatments.

With the evolution and proliferation of fluoroscopy, a broader group of medical professionals have become engaged in its daily use, and subject to its inherent danger, being exposure to radiation. Increasingly, nurses, surgeons, physicians and technologists, in addition to radiologists or radiologic technologists are either working with fluoroscopy or are present during its use.

While improving technology has decreased the radiation dose rates from what they were in the past, the use of fluoroscopy for treatment has not only expanded but has also called for increased exposure times, which length of radiation exposure often offsets the dose reductions realized by improved technology.

Thus, radiation safety is even more of an issue today than twenty-five years ago. Increasingly, personnel who are involved in the performance of these medical procedures are wearing radiation protective garments for longer periods of time. Radiation protective garments for use by persons subject to ionizing radiation during medical fluoroscopy or other activities are well known in the prior art. Such garments generally comprise inner cloth or vinyl linings and an outer cloth or vinyl covering with an intermediate layer of lead. This increased, prolonged usage of heavy radiation protective garments has caused the wearers of these garments certain types of fatigue and discomfort associated with the weight of the garment at the pressure points where the weight of the garment is transferred to the body.

A number of fatigue and discomfort problems have been directly linked to the weight of the garment that is placed upon the wearer's shoulders. Pressure upon the musculature of the shoulders and upper back has been identified as undesirable. Most recently physicians have identified this condition as "thoracic outlet syndrome" which has been directly linked to the weight of a radiation protective apron that bears upon the shoulders. In some cases even minimizing the weight on the shoulder area is insufficient to relieve the problem once it has manifested itself. Current treatment in severe cases of thoracic outlet syndrome can involve surgery.

SUMMARY OF THE INVENTION

It is an object of this invention to provide means to support the weight of a radiation protective garment off a wearer's shoulders, such radiation protective garment being of the type used during medical x-ray fluoroscopic procedures in which the operator of the fluoroscopic equipment and other occupational personnel are subject to exposure by ionizing radiation, such as directly and indirectly from x-ray fluoroscopic equipment.

It is a further object of this invention to provide a radiation protective garment with a support structure which supports all of the garment's weight at the waist and hips of the wearer rather than on the wearer's shoulders.

In one embodiment of this invention a pair of sturdy, inverted U-shaped stay members are utilized, the bottom portions of which are attached to an elastic support belt and worn under the radiation protective garment. In another embodiment the stay members are incorporated into the body of the radiation protective garment. After cinching the belt over the bottom portions of the pair of stay members, the garment is manually raised and maintains this position by the support belt so that the upper portions of the garment are supported on the stay members and not on the shoulders of the wearer of the garment. In another embodiment of the invention the stay members are disposed within the radiation protective garment. A belt supports and lifts the garment and stay members, taking all of the garment's weight off the wearer's shoulders and transferring such weight to the waist/pelvic area of the wearer. As a result, all fatigue problems related to weight on the wearer's shoulders and repetitive stress of prolonged shoulder contact are eliminated.

This removal of weight from the shoulders is achieved by using a semi-rigid plastic, such as Lexan, or metal stay members. In some embodiments the stay members are stitched onto the inner lining or otherwise disposed between the inner lining and outer covering of the radiation protective garment. In such embodiments the stay members are maintained in their upward position by the action of an elastic support belt, causing a condition of zero weight load upon the shoulders of the wearer of the garment. In another embodiment the stay members can be independent of the garment and are worn under the radiation protective garment.

One example of this invention two Lexan stay members are utilized, each being 2½ inches wide by 25 inches long by 3/16 inch thick. Each stay member can be stitched into the inner lining of the garment and extends vertically from the back at the level of the support belt, at the waist area, up the back of the garment and arches over the shoulder of the wearer, thus forming an inverted J-shaped member. The stay members can be removable from the garment in some embodiments. Different length stay members can be used for different sized garments. Elastic support belts are commonly used and are well-known in the industry. The support belt holds the weight of the garment off the shoulders of the wearer by inward pressure against the garment and the bottom(s) of the stay member(s), holding the uppermost parts of the stay member(s) off the wearer's shoulders and preventing them from being moved downward onto the wearer's shoulders by the weight of the radiation protective garment. The support belt cannot move downward because it is held by its own compression tightly against the garment and wearer's body. The limited flexibility of the stay members provides the user with an adequate level of comfort to put on and take off the garment. In an alternate embodiment the support belt can support independent stay members under the radiation protective garment. These independent stay members can extend completely over the wearer's shoulders and down to the front of the support belt or they can also be in an inverted J-shape. An important feature of the embodiment with built-in stay members is that the height of the garment as measured from a point on the support belt near the bottom of a stay member to the top of the garment at the shoulder area is greater than the distance from the same point on the support belt to the top of the wearer's shoulder crossed by the stay member, resulting in a space between the shoulder of the wearer and the garment.

DESCRIPTION OF THE PREFERRED EMBODIMENT(S)

Figure 1:
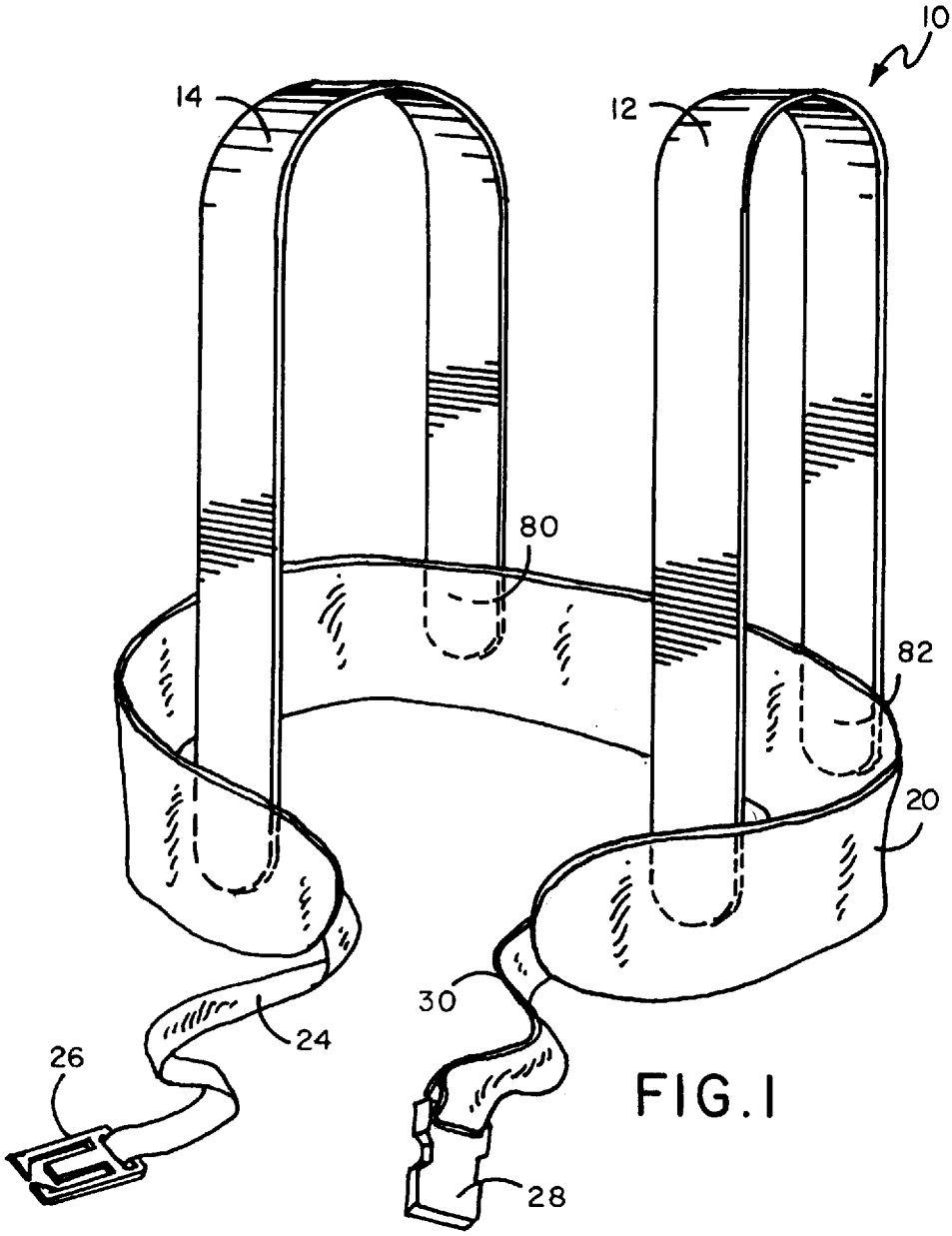
FIG. 1 illustrates a perspective view of one embodiment of the invention having two vertical stay members and a support belt to be worn under a radiation protective garment.

In FIG. 1, radiation protective garment support member 10 is seen which is to be worn under a radiation protective garment. Support belt 20 is tightened against the wearer's waist, and first and second stay members 12 and 14 which are attached to the front and rear of the support belt are able to support the entire weight of the garment, not shown, off a wearer's shoulders.

Figure 2:
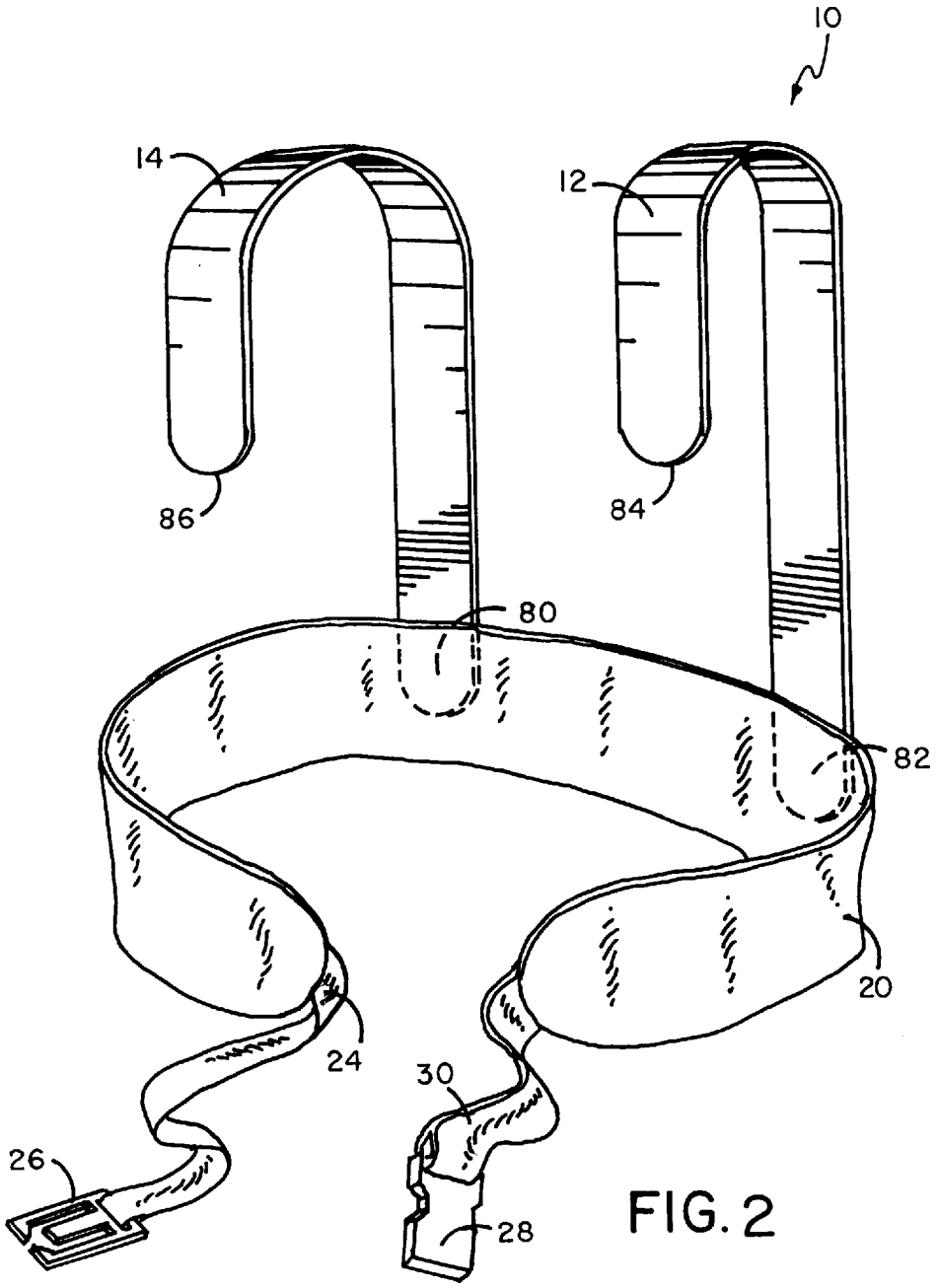
FIG. 2 illustrates a perspective view of an embodiment of the invention having two vertical stay members and support belt to be worn under a radiation protective garment with J-shaped support members that do not extend down to the belt's front waist portion.
Figure 4:
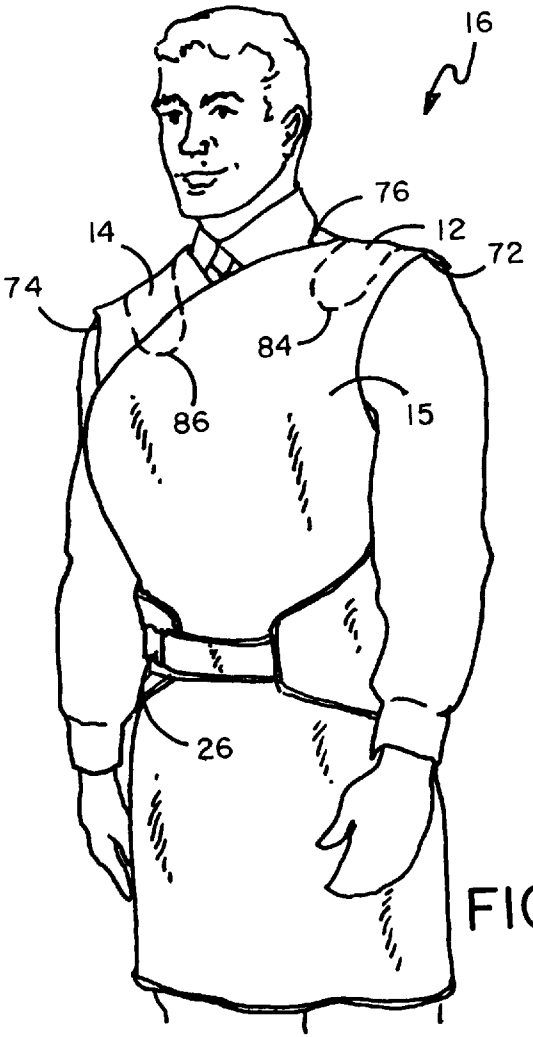
FIG. 4 illustrates a front perspective view of a person wearing the radiation protective garment of FIG. 3 with the stay members not extending down to the waist area at the front of the garment.

FIG. 2 illustrates an alternate embodiment of the radiation protective garment support member of FIG. 1 wherein first and second stay members 12 and 14 do not extend down to the front of the support belt but come to an end after they have passed over the shoulder area, terminating respectively at first and second front ends 84 and 86 and are supported by their attachment to support belt 20 at their respective first and second rear ends 82 and 80. In both the embodiments of FIGS. 1 and 2 support belt 20 can be made of an elasticized material which belt can be secured around the wearer by first and second straps 30 and 24 and respective mating buckle means 28 and 26.

Figure 3:
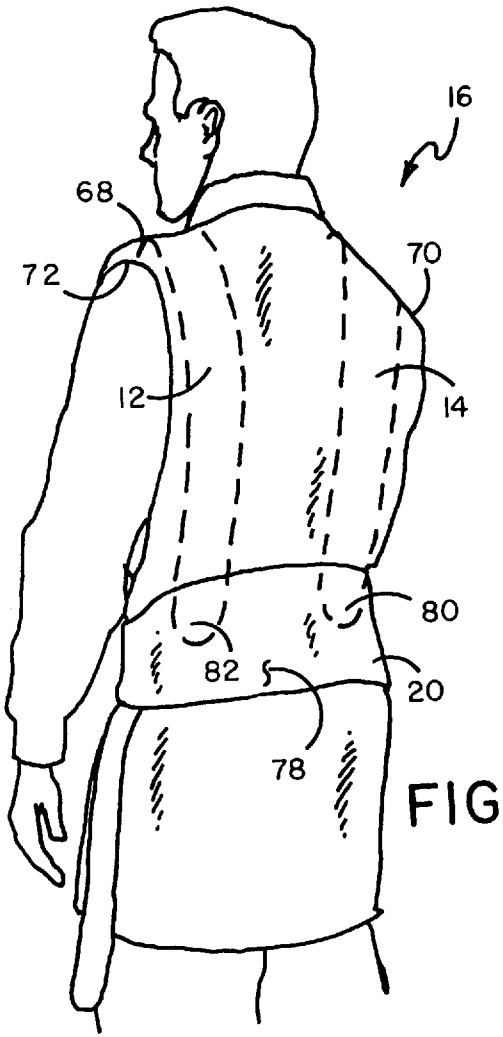
FIG. 3 illustrates a rear perspective view of a person wearing a radiation protective garment having a pair of spaced-apart, built-in stay members.

FIG. 3 illustrates a rear perspective view of radiation protective garment 16. This embodiment of the garment has panels which close on a front side and are held together when closed by closure means such as Velcro strips. The upper portion of garment 16 has first and second shoulder area portions 68 and 70 covering the wearer's shoulders, first and second arm holes 72 and 74, and neck opening 76. The lower portion of garment 16 has belt receipt area 78 where support belt 20 can be wrapped therearound and tightened around the wearer's waist. The belt can be adjusted and then fastened together such as by mating buckles 26, as seen in FIG. 1. The garment includes outer covering 15 and an inner lining, not seen, which can be stitched together at the edges of the garment. Particles of lead or other radiation-attenuating materials are encapsulated in a flexible vinyl matrix and sandwiched between outer covering 15 and the inner lining, protecting the wearer of garment 16 against radiation exposure. First and second stay members 12 and 14 can be stitched to the inner lining of garment 16, or alternatively they can be sewn within outer covering 15. First and second stay members 12 and 14 proceed vertically, respectively, from their rear ends 82 and 80 disposed inward of support belt 20 at the rear of garment 16, and extend up and arch over the wearer's shoulders and proceed downward somewhat to their respective front ends 84 and 86. First and second stay members 12 and 14 must be made of material of sufficient strength to support the radiation protective garment above the wearer's shoulders. The radiation protective garment supports of this invention can be provided in different sizes to accommodate all wearers of the garment. Support belt 20 is of the type commonly used in the industry but in addition can have garment attachment means thereon or can be permanently attached to the radiation protective garment at its waist portion. At least one of the mating buckles can include conventional means for adjusting the length of the strap(s). First and second stay members 12 and 14 can be made from either a rigid or semi-rigid plastic or metal strips of sufficient strength to support the weight of garment 16, which can typically be 10 lbs of weight, off the wearer's shoulders. In one preferred embodiment, first and second stay members 12 and 14 can each be made from Lexan plastic in the following dimensions: 2½ inches wide by 25 inches long by 3/16 inch thick. Support belt 20 can apply pressure on the stay members' first and second rear ends 82 and 80 when the belt is tightened against the garment and the wearer's body therewithin so as to maintain the bottom portions of the stay members in position when such stay members are manually maneuvered not to have their shoulder portions resting on the wearer's shoulders.

In the embodiments illustrated, the garment opens along one side and across one shoulder of the garment. The side and shoulder closure members are held together by Velcro strips. The garment is also fastened at one side of the wearer by overlapping side Velcro closures. This style of radiation protective garment is well known, and the invention herein can be incorporated into it or used with other styles of radiation protective garments.

Figure 6:
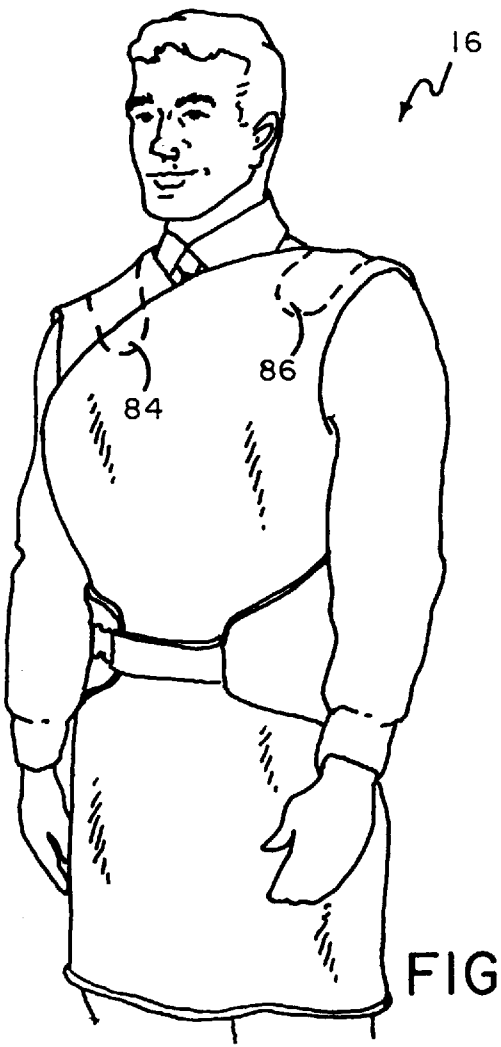
FIG. 6 illustrates a front perspective view of the garment of FIG. 5.
Figure 5:
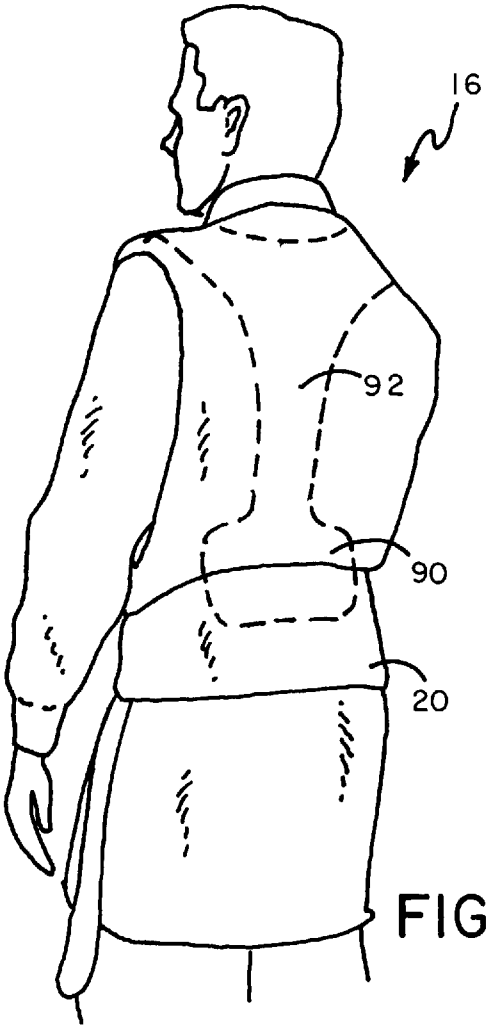
FIG. 5 illustrates a rear perspective view of a person wearing a radiation protective garment having a unitary stay member extending up the back and splitting into two shoulder portions.

FIGS. 5 and 6 illustrate, respectively, a rear and front perspective views of an alternate embodiment of the invention wherein the support member is affixed within radiation protective garment 16 but is not a multiple piece structure. The integral support member of FIG. 5 has a lower enlarged planar member 90 positioned so as to be supported at the waist support area between support belt 20 and the wearer.

Lower enlarged planar member 90 extends upward to form a central upwardly extending rib member which at shoulder height bifurcates, with each side branching over the wearer's shoulders to form first and second front ends 86 and 84, raising the radiation protective garment off the wearer's shoulders.

Figure 8:
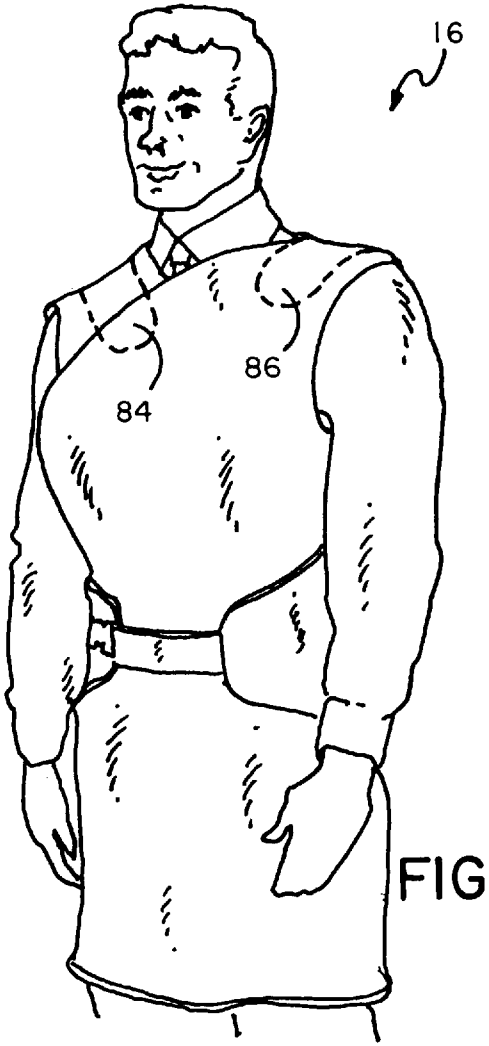
FIG. 8 illustrates a front view of the embodiment of FIG. 7.
Figure 7:
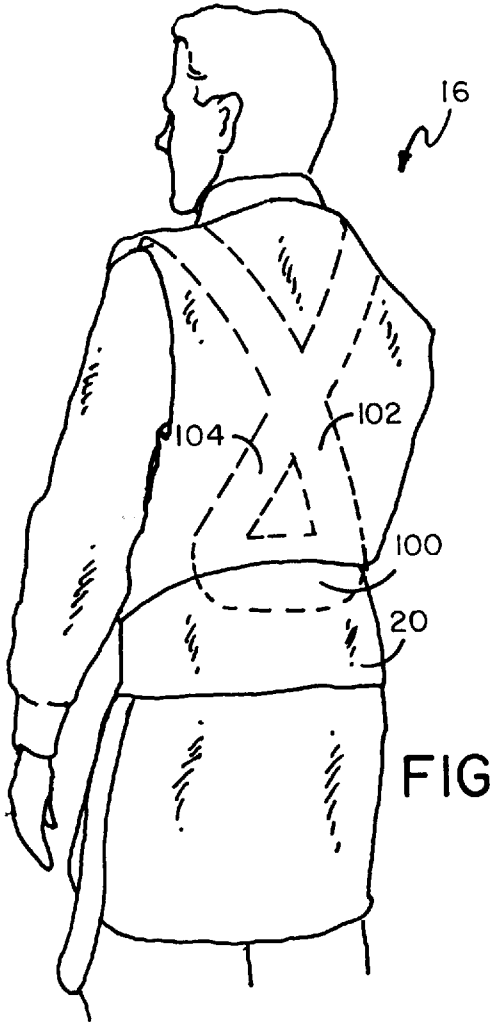
FIG. 7 illustrates a rear perspective view of a further alternate embodiment of the radiation protective garment support of this invention with stay members forming an X in the rear of the garment.

In yet another embodiment shown in FIGS. 7 and 8, the stay members can start with an enlarged rear portion 100 disposed at the wearer's waist under support belt 20 which portion has two members 102 and 104 extending upwards therefrom to form an X-shaped rear portion. The X-shaped portion can be an integral piece or members 102 and 104 can cross one another to pass over the shoulders of the wearer to form first and second front ends 86 and 84 to lift the radiation protective garment off the wearer's shoulders.

Figure 10:
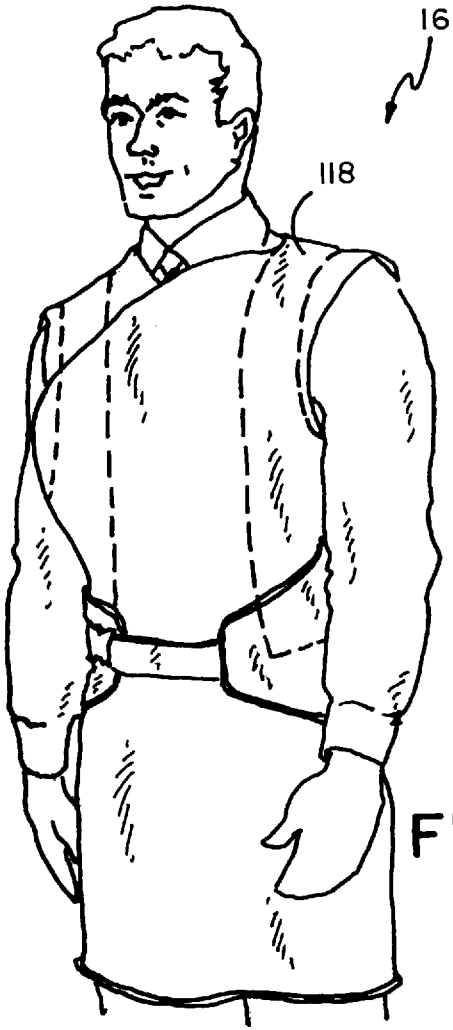
FIG. 10 illustrates a front perspective view of the embodiment of FIG. 9.
Figure 11:
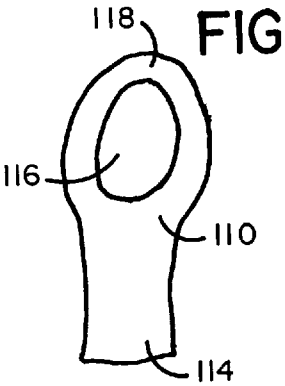
FIG. 11 illustrates one of the stay members of FIGS. 9 and 10, showing the aperture defined therein.
Figure 9:
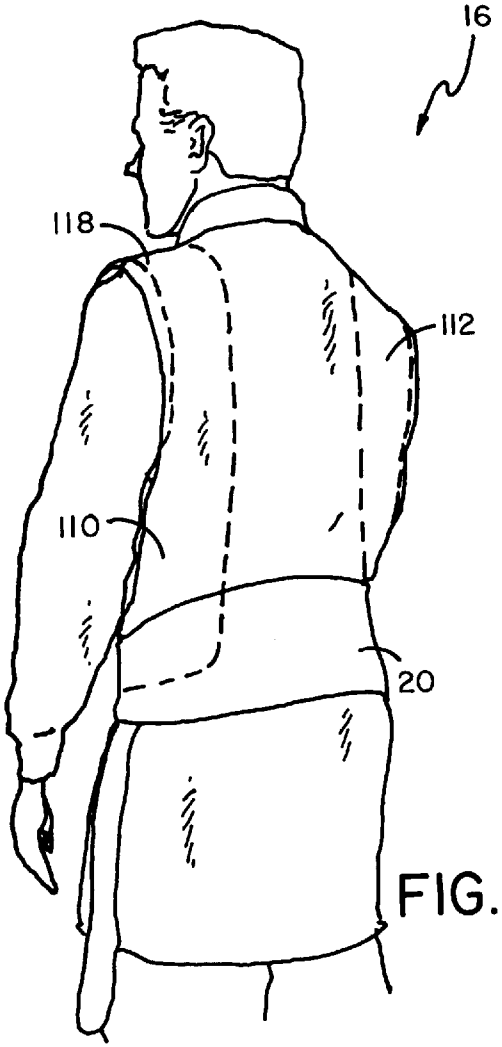
FIG. 9 illustrates a rear perspective view of a person wearing a radiation protective garment with stay members disposed in the sides thereof, each extending upwards and encircling an arm of the wearer.

The support members do not necessarily have to extend from the back of the wearer over the shoulders but can, for example, be formed of a stiffened insert disposed within the radiation protective garment on each side thereof, such as first and second inserts 110 and 112 shown in FIGS. 9 and 10. These inserts start at a lower portion 114, as seen in FIG. 11, and extend upwards on each side of the wearer, each insert having an aperture 116 formed therein through which the wearer's arm can pass, with top shoulder portion 118 of each insert providing the support necessary to hold the radiation protective garment off the wearer's shoulder. Top shoulder portion 118 can be angled downward from the neck to the arm to conform to the wearer's body shape. FIG. 11 illustrates a side view of one such insert shown separated from its radiation protective garment.

Although the present invention has been described with reference to particular embodiments, it will be apparent to those skilled in the art that variations and modifications can be substituted therefor without departing from the principles and spirit of the invention.

I claim:

1. A radiation protective garment for use by a wearer having a waist and shoulders, comprising:

a flexible inner lining and outer covering containing radiation protective material disposed therebetween, said garment having a weight, a first side, a second side, a front portion having a top portion, a waist portion and a bottom portion, a rear portion having a top portion, a waist portion and a bottom portion, and two shoulder portions;

at least one stay member disposed within said garment, said stay member having a bottom end, a front end and a top portion, said stay member extending from its bottom end disposed at said rear waist portion of said garment vertically under said garment's respective top portion corresponding to the shoulder area of the wearer to its front end;

a support belt having means for securing said support belt tightly around said front waist portion of said garment;

said support belt for manually positioning said top portion of said stay member above said shoulders of said wearer wherein all of said weight of said garment is supported by said stay member which is held in place by the pressure of said support belt on said bottom end of said stay member against said waist of said wearer.

2. The garment of claim 1 wherein said stay member is in the form of an inverted "J".

3. The garment of claim 2 wherein there are first and second stay members, one extending above each shoulder of said wearer.

4. The garment of claim 3 wherein said first and second stay members are disposed between said inner lining and said outer covering of said garment.

5. The garment of claim 4 wherein said first and second stay members are made from a semi-rigid plastic sufficiently strong to support and remove the weight of said garment from said wearer's shoulders.

6. The garment of claim 4 wherein said first and second stay members are made from a metal sufficiently strong to support and remove the weight of said garment from said wearer's shoulders.

7. The garment of claim 4 wherein said means for securing said support belt include an elasticized stretchable member.

8. The garment of claim 4 further including means for securing said support belt to said garment.

9. The garment of claim 8 wherein said means for securing said support belt to said garment are Velcro fastening means.

10. A radiation protective garment for use by a wearer having a waist and shoulders, comprising:

a flexible inner lining and outer covering containing radiation protective material disposed therebetween, said garment having a weight, a first side, a second side, a front portion having a top portion, a waist portion and a bottom portion, a rear portion having a top portion, a waist portion and a bottom portion, first and second shoulder portions and first and second side portions;

first and second stay members each formed with an arm aperture defined therein, said first and second stay members disposed within said garment, each stay member having a bottom end and a top portion, each stay member extending vertically from its bottom end at its respective side portion of said garment to a height such that its top portion is higher than said shoulder of said wearer; and a support belt having means for securing said support belt tightly around said waist portion of said garment, said support belt for manually positioning said top portions of said first and second stay members above said shoulders of said wearer wherein all of said weight of said garment is supported by said first and second stay members which are held in place by the pressure of said support belt against said bottom ends of said stay members against said waist of said wearer.

11. The garment of claim 10 wherein said first and second stay members are made from a semi-rigid plastic sufficiently strong to support and remove the weight of said garment from said wearer's shoulders.

12. The garment of claim 10 wherein said first and second stay members are made from a metal sufficiently strong to support and remove the weight of said garment from said wearer's shoulders.

13. The garment of claim 10 wherein said means for securing said support belt include an elasticized stretchable member.

14. The garment of claim 10 further including means for securing said support belt to said garment.

15. Shoulder support means for a radiation protective garment for use by a wearer having a waist and shoulders, said garment of the type having a flexible inner lining and outer covering containing radiation protective material disposed therebetween, said garment having a weight, a first side, a second side, a front portion having a top portion, a waist portion and a bottom portion, a rear portion having a top portion, a waist portion and a bottom portion, first and second shoulder portions, and first and second side portions, comprising:

first and second stay members each formed in an inverted "J" shape, said first and second stay members each having a bottom end, a front end and a top portion corresponding to the shoulder area of said wearer, each stay member extending from its bottom end positioned at the rear waist portion of said wearer and extending vertically over one shoulder of said wearer and terminating at said front end; and a support belt having means for attaching said support belt to said bottom ends of said first and second stay members and means for securing said support belt tightly around said waist portion of said wearer, said support belt for manually positioning said top portions of said first and second stay member above and off said shoulders of said wearer wherein all of said weight of said garment when put on over said first and second stay members and said support belt is supported by said first and second stay members which is held in place by said support belt on said waist of said wearer.

16. A method of supporting the weight of a radiation protective garment on the waist/pelvic area of a wearer, said garment for use in an environment of x-ray radiation, said garment having a front, a back, first and second side portions, a waist area portion, and first and second shoulder portions, said first and second shoulder portions each having a top point, comprising the steps of:

providing first and second stay members disposed, respectively, within said garment, each of said stay members extending from the rear waist area portion of said garment, over its respective shoulder portion;

providing a support belt attached at said waist area portion of said garment;

securing said support belt tightly about said waist area portion of said garment;

manually lifting said garment such that the distance from a point on said support belt near the bottom of a stay member at said waist of the wearer to the top of his shoulder is less than the distance measured from said same point on said support belt to the top point of its respective shoulder portion of said garment;

maintaining said first and second stay members at said height where its shoulder portions are positioned above and off the shoulders of said wearer; and supporting said weight of said garment on said first and second stay members by pressure of said support belt securely positioned against said waist portion of said garment.

17. A method of supporting the weight of a radiation protective garment on the waist/pelvic area of a wearer, said garment for use in an environment of x-ray radiation, said garment having a front, a back, first and second side portions, a waist area portion, and first and second shoulder portions, said first and second shoulder portions each having a top point, comprising the steps of:

providing at least one stay member, said stay member extending from the waist area portion of said wearer, over a respective shoulder of said wearer;

providing a support belt attached to said stay member(s);

securing said support belt tightly about said waist area portion of said wearer;

placing said radiation protective garment on said wearer;

raising said garment by manually lifting said stay member (s) such that the distance from a point on said support belt near the bottom of each of said stay member(s) at said waist of the wearer to the top of his shoulder is less than the distance measured from said same point on said support belt to the top point of its respective shoulder portion of said garment;

maintaining said stay member(s) at said height where its upper portion are positioned above and off the shoulders of said wearer; and supporting said weight of said garment on said stay member(s) by pressure of said support belt securely positioned against said waist of said wearer.

* * * * *